US009986819B2

(12) United States Patent
Flynn

(10) Patent No.: US 9,986,819 B2
(45) Date of Patent: Jun. 5, 2018

(54) TOOTH CLEANING DEVICES AND PROCESSES FOR USING SAME

(71) Applicant: Joelle S. Flynn, Dana Point, CA (US)

(72) Inventor: Joelle S. Flynn, Dana Point, CA (US)

( * ) Notice: Subject to any disclaimer, the term of this patent is extended or adjusted under 35 U.S.C. 154(b) by 0 days. days.

(21) Appl. No.: 15/245,649

(22) Filed: Aug. 24, 2016

(65) Prior Publication Data

US 2018/0055211 A1 Mar. 1, 2018

(51) Int. Cl.

| | |
|---|---|
| ***A46B 11/00*** | (2006.01) |
| ***A46B 5/02*** | (2006.01) |
| ***A46B 15/00*** | (2006.01) |
| ***A46B 9/04*** | (2006.01) |

(52) U.S. Cl.

CPC ..... *A46B 11/0006* (2013.01); *A46B 5/026* (2013.01); *A46B 9/04* (2013.01); *A46B 11/0003* (2013.01); *A46B 15/0087* (2013.01); *A46B 15/0093* (2013.01); *A46B 2200/1066* (2013.01)

(58) Field of Classification Search

CPC combination set(s) only.
See application file for complete search history.

(56) References Cited

U.S. PATENT DOCUMENTS 1,811,833 A * 6/1931 Simon ..... A46B 11/001 15/104.94
1,947,720 A * 2/1934 Laub ..... A46B 11/0003 15/176.1
2,550,190 A * 4/1951 Greenberg ..... A46B 11/0003 15/167.1
3,536,410 A * 10/1970 Wargoe ..... A46B 11/0003 401/132
4,051,571 A * 10/1977 Ayers ..... A46B 9/04 15/143.1
5,366,310 A * 11/1994 Armelles Flors .. A46B 11/0003 401/132
D368,374 S * 4/1996 Ashcraft ..... 401/184
5,599,126 A * 2/1997 Hough ..... A46B 11/0003 401/132

* cited by examiner

*Primary Examiner* — David Walczak
(74) *Attorney, Agent, or Firm* — Kilpatrick Townsend & Stockton LLP

(57) ABSTRACT

Tooth cleaning devices that are designed for portable, discrete use improve dental hygiene as well as cosmetic appearance of teeth. For example, teeth can be discreetly cleaned after drinking dark-colored beverages in social settings wherein conventional teeth cleaning devices are unavailable or inconvenient. The portable and discrete tooth cleaning devices can be used with described processes and stored and dispensed with described devices.

15 Claims, 4 Drawing Sheets

FIG. 1
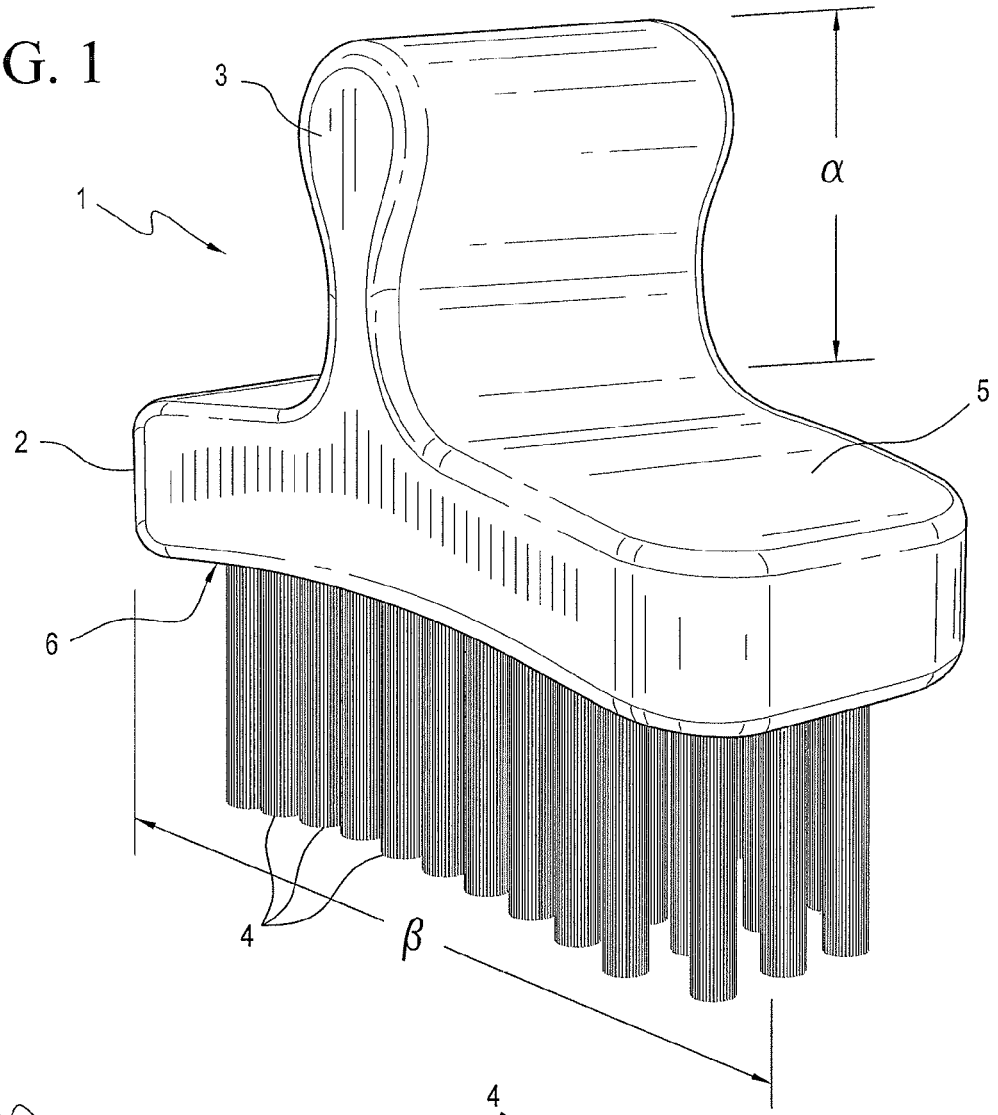
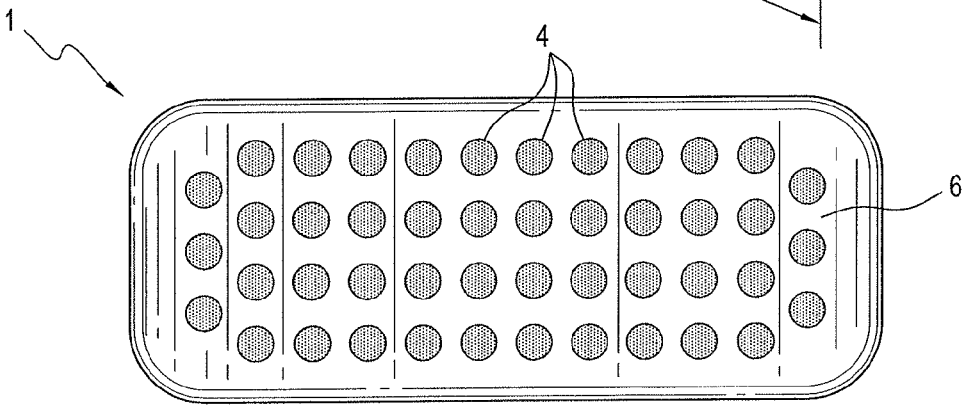
FIG. 2

TOOTH CLEANING DEVICES AND PROCESSES FOR USING SAME

FIELD OF THE INVENTION

The present invention relates generally to devices for cleaning teeth and to processes for using same. Specifically, the present invention relates to portable tooth cleaning devices that allow for discreetly cleaning one's teeth when conventional tooth cleaning products and/or water are unavailable or inconvenient as well as the use of those devices.

BACKGROUND OF THE INVENTION

Good dental hygiene is advantageous for health and cosmetic reasons. Various means exist by which individuals may clean their teeth. The vast majority of tooth cleaning devices are designed consistent with in-home use. For example, conventional tooth brushes are large enough to fit conveniently within a fully clenched hand and have bristles exposed to the open air. Storage of these devices requires containers that are several inches in length and more than one or two inches in diameter. The large size of conventional tooth brushes provides a durable and reusable product that may be used numerous times before the device is substantially degraded to the point necessitating disposal. Although the large size and durability of conventional tooth brushes render them well suited for repeated home use, these characteristics make them inconvenient when away from home or "on-the-go." In addition, water and tooth paste are typically required for the use of conventional tooth brushes, making their use inconvenient or impossible when water and tooth paste are not readily available.

Various other means have been created in attempts to address the need for a more portable tooth cleaning device. For example, U.S. Pat. No. 6,397,860 discloses a disposable, waterless tooth brushing assembly that includes a toothbrush, a non-foaming, saliva-activated, oral care composition pre-applied to the bristles of the toothbrush, a small moistened disposable towel for use after tooth cleaning, and a compact, lightweight, two-layer heat-sealed packaging container for pre-use sanitary storage of the toothbrush and towel.

U.S. Pat. No. 7,182,542 discloses a waterless disposable toothbrush that includes a handle having a toothpick connected thereto to enable cleaning between teeth, and a rupturable dispenser containing a dentifrice and being connected in a bristle portion of the toothbrush head for dispensing the dentifrice to the teeth.

U.S. Pat. No. 7,478,959 discloses an oral care toothbrush that includes a head mounted to one end of the handle containing a plurality of oral care elements. An oral care accessory is mounted to the opposite end of the handle. An oral care composition dispenser is mounted to the head within the cleaning field defined by the oral care elements.

U.S. Pub. No. 2011/0239387 discloses an oral care toothbrush that includes a handle having a head at one end of the handle, the head having at least one cleaning element and at least one oral care dispenser. The oral care dispenser releases the oral care matter within about five seconds when exposed to water.

Various packaging methods have also been created in an attempt to conveniently house portable tooth cleaning devices. For example, U.S. Pub. No. 2010/0230312 discloses a package for displaying a plurality of items where the package has first and second containers connectable between an open position and a closed position, each container having an outer surface having at least one elongated protrusion, with the head end extending further outwardly from the package than the tail end. The head end of the at least one protrusion of the first container is proximate to the tail end of the at least one protrusion of the second container in the closed position.

Portable tooth freshening and cleansing devices are becoming more common. For example, "portable" concentrated mouthwash strips have become popular among those who are concerned with dental freshness.

Gum products have also tried to capitalize on the desire to clean teeth while on the go. Many modern chewing gum manufacturers market at least one significant line of chewing gum as "whitening" or "dental cleaning" gums.

In an effort to cosmetically improve tooth appearance, consumers have increasingly turned to tooth bleaching or whitening. There are many commercially available methods for whitening teeth, such as brushing, bleaching strips, bleaching pens, bleaching gels, laser bleaching, and natural bleaching. Traditionally, at-home whiteners use overnight trays containing a carbamide peroxide gel which reacts with water to form hydrogen peroxide. Some whitening techniques may undesirably open dentinal tubules causing increased tooth sensitivity and potentially resulting in temporary tooth stains after drinking certain dark colored liquids such as coffee, tea or red wine.

In view of the foregoing, the need exists for compact, ready-to-use tooth cleaner and freshener devices that may be used quickly and discretely in social settings preferably without the need for additional material such as separate tooth paste, cleanser or water. The need also exists for portable and discrete devices for removing dental stains and, in particular, for removing temporary tooth stains resulting from dark colored liquids. The need also exists for improved packaging for such tooth cleaning devices that allow the tooth cleaning devices to be kept clean and fresh until time for use.

SUMMARY OF THE INVENTION

In one embodiment, the present invention is directed to a tooth cleaning device, comprising a substantially planar base having opposing first and second sides; a grip member extending proximally from the first side; a plurality of first bristles attached to and distally extending from the second side; optionally a plurality of second bristles attached to and distally extending from the second side; and an oral care composition disposed within a housing or on the first bristles.

In one aspect, the oral care composition is disposed on the first bristles as a solid at room temperature, and may be activated upon contact with a user's saliva.

In another aspect, the oral care composition is disposed within a housing comprising a flexible capsule, which is optionally replaceable, disposed at least in part within the grip member and extending through the base, the capsule further comprising a removable tab extending distally from the second side of the base. In this aspect, the capsule may comprise one or more perforations for facilitating removal of the tab, wherein removal of the tab creates an opening through which the oral care composition may be dispensed. The capsule may be held in place by a plurality of prongs extending from the grip member to create a rim about the proximal boundary of the capsule. The capsule may be formed, for example, of a material selected from the group consisting of plastic, polypropylene, silicon, nylon, and combinations thereof.

In another aspect, the oral care composition is disposed within a housing that forms a cavity within the grip member, bounded proximally by a plunger and distally by an opening to the second side of the base. In this aspect, the device has a first position wherein the plunger protrudes proximally from the grip member, and a second position where the plunger is depressed laterally into the grip member and protrudes proximally to a lesser extent than the first position. In this aspect, distal movement of the plunger may disperse the oral care composition through the opening and onto the first bristles, and optionally such that when fully depressed, the plunger is locked into place by a plurality of prongs.

In various embodiments, the base may have a lateral cross-sectional shape that is selected from the group consisting of circle, oval, square, rectangle, and triangle. The grip member has a proximal grip length, and the base has a maximum lateral dimension, and the ratio of the proximal grip length to the maximum lateral dimension is optionally less than 2, e.g., less than 1.5 or less than 1.0.

In some aspects, the device comprises a plurality of second bristles attached to and distally extending from the second side, wherein the first bristles are disposed along a first perimeter area of the base, and the second bristles are disposed along a second perimeter area of the base. The first bristles optionally have a maximum length less than 1 cm. In some aspects, the first bristles extend distally from the second side of the base at an angle ranging from 35 to 55 degrees.

In another embodiment, the invention is to a packaging device, comprising: a substantially rigid sleeve; an insert containing multiple tooth cleaning devices, said devices being individually sealed within cavities in the insert; wherein said insert is slidably engaged with said sleeve between a first position in which the insert is substantially fully contained within the sleeve, and a second position in which the insert extends outside of the sleeve such that one of the tooth cleaning devices can be dispensed from the insert upon application of pressure onto one of the cavities by a user. The sleeve optionally comprises a paperboard material. The insert optionally comprises (a) a substantially planar housing having the cavities formed therein, and (b) a sealing material adhered to the housing such that the devices are sealed within respective cavities in the housing. In this embodiment, each of said tooth cleaning devices may comprise a substantially planar base having opposing first and second sides; a grip member extending proximally from the first side; a plurality of first bristles attached to and distally extending from the second side; and an oral care composition disposed within a housing or on the first bristles.

In another embodiment, the invention is to a process for using a tooth cleaning device, comprising: (a) providing the tooth cleaning device, wherein the device comprises a substantially planar base having opposing first and second sides; a grip member extending proximally from the first side; a plurality of first bristles attached to and distally extending from the second side; optionally a plurality of second bristles attached to and distally extending from the second side; and an oral care composition disposed within a housing or on the first bristles; (b) gripping the grip member; (c) dispensing the oral care composition such that the oral care composition is released onto the first bristles; and (d) activating the oral care composition with the user's saliva and brushing the user's teeth with the first bristles. The oral care composition optionally is adhered to the first bristles at the time of manufacture, and the dispensing in step (c) is thus accomplished at the time of manufacture. In another aspect, the dispensing in step (c) comprises removing a tab and squeezing the oral care composition out of a housing disposed within the grip member onto the first bristles. In another aspect, the dispensing in step (c) comprises distally compressing a plunger.

In various aspects of the above embodiments, the oral care composition is selected from the group consisting of: cleaning agents, surfactants, thickening agents, buffering agents, whitening agents, sweeteners, flavorants, and combinations thereof.

BRIEF DESCRIPTION OF DRAWINGS

These and other objectives, features and advantages of the present invention are described in the following detailed description of the specific embodiments and are illustrated in the following Figures in which:

FIG. 1 is a perspective side view of a tooth cleaning device according to a first embodiment of the present invention;

FIG. 2 is a bottom view of the tooth cleaning device according to the first embodiment of the present invention;

DETAILED DESCRIPTION OF THE INVENTION

Figure 3:
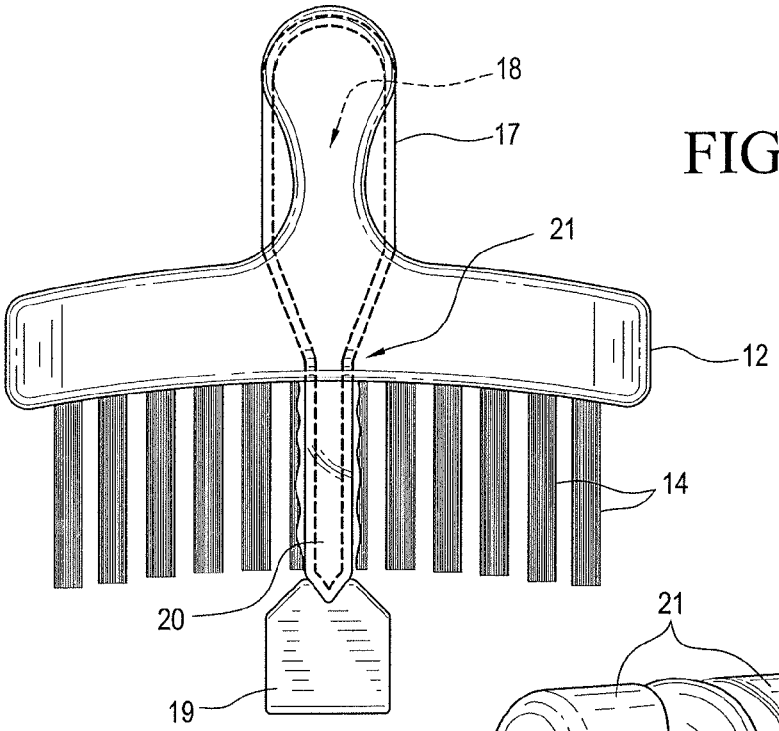
FIG. 3 is a side view of a tooth cleaning device according to a second embodiment of the present invention.

The following detailed description refers to the accompanying drawings. The same reference numbers in different figures identify the same or similar elements.

The following term definitions are provided and apply to the present invention. As used herein, the term "proximal" refers to the direction from the device to the user's hand in normal usage of the device. The term "distal" refers to the direction from device to the user's teeth in normal usage of the device.

FIGS. 1-2 illustrate a tooth cleaning device 1 according to one embodiment of the invention, which includes a base 2, grip member 3, and bristles 4. An oral care composition preferably is preloaded onto or within the bristles. For example, in one aspect, a solution comprising a solvent, e.g., water, and an oral care composition dissolved, dispersed or otherwise carried therein is dispensed onto the bristles during manufacture. The solvent is subsequently removed, preferably with the application of heat and/or vacuum, such that the oral care composition remains as a solid upon the external surface of the bristles, but may be mobilized for tooth cleansing upon contact with a user's saliva or water. In another aspect, the bristles contain pores and the oral care composition forms as a solid within the pores.

In a preferred embodiment, as shown in FIGS. 1-2, base 2 and grip member 3 are integrally formed in a single molding operation, preferably an injection molding operation. The base and/or grip member may be formed of a variety of materials, but preferably are substantially rigid, and optionally formed of a plastic such as polyethylene and/or polypropylene, optionally in combination with one or more other plastics, silicone, nylon or a combination thereof. In another embodiment, the grip member comprises a soft elastomeric polymer, silicone or styrene butadiene rubber (SBR) to facilitate gripping by a user.

In some embodiments, the base has a substantially planar shape, optionally in the shape of a substantially planar rectangle. As shown, the base may alternatively have a slightly arcuous shape. The base preferably includes a proximal surface 5 and a distal surface 6, either or both of which may flat or arcuous. In the embodiment shown in FIGS. 1 and 2, both the proximal and distal surfaces are arcuous. Although the specific size and shape of the base may vary widely, in some preferred embodiments, the base is rectangular in shape and has sides of length 0.5-2 cm, e.g., from 1 to 1.5 cm, optionally with slightly rounded edges, as shown, to allow for a comfortable fit around the user's teeth. The width of the base preferably ranges from 0.25 to 1.5, e.g., from 0.5 to 1 cm. The ratio of the length to the width is preferably greater than 1:1, e.g., greater than 1.5:1 or greater than 2:1. In some aspects, the base may have a lateral cross-sectional shape of a circle, oval, rectangle, triangle, or other polygon.

As shown in FIGS. 1-2, grip member 3 is attached to the proximal side of base 2 and may be integrally molded with the base during manufacture. In other embodiments, the grip member may be formed of a different material than the base. The grip member is provided to be held by the user's fingers when using the device. Either or both the base and/or the grip member may be clear, translucent, or opaque. When the grip member is translucent, the tooth cleaning device may be used more discreetly, as it may be less visible to others. The specific length ($\alpha$) of the grip member may vary widely, but optionally ranges from 0.5 cm to 2 cm, e.g., from 1 to 1.5 cm.

In preferred embodiments, the grip length is small compared to conventional tooth cleaning devices. For example, with reference to FIG. 1, in some embodiments, grip member 3 has a proximal grip length $\alpha$, and base 2 has a maximum lateral dimension $\beta$, and the ratio of the proximal grip length to the maximum lateral dimension is less than 2, less than 1, or less than 0.5.

Either or both the base and/or the grip member may further comprise one or more gripping features such as dimples, bumps or ridges protruding from portions of the surface thereof. The gripping features may provide a decorative appearance to the base and/or the grip member or may be used to enhance gripping of the grip member during use of the device. The dimples may be formed from the same material as the grip member and/or the base or from a soft elastomeric polymer adhered thereto. Examples of soft elastomeric polymers include natural or synthetic rubber polymers, including oil-modified styrene/ethylene-butadiene/styrene block copolymers, highly plasticized polyvinyl chloride elastomers, silicone rubbers and polyurethane elastomers.

As shown in FIGS. 1-2, the bristles 4 may be attached to the distal side of base 2 during manufacture. In one embodiment, as shown in FIGS. 1-2, the bristles 4 extend distally from the distal side of base 2 in a direction substantially perpendicular to the base. In another embodiment, either or both first bristles and/or second bristles may extend out from the base at an angle ranging from 30 to 60 degrees, e. g., from 35 to 55 degrees or from 40 to 50 degrees, to increase brushing resistance with respect to the teeth during operation and facilitating tooth cleansing. The bristles preferably function to move the oral care composition across the teeth and loosen particulates and/or remove stains from the teeth. In some embodiments, not shown, the bristles include first bristles and second bristles, where the first and second bristles have a physical characteristic different from one another. For example, the first bristles may be formed of a different material from the second bristles, may have a different length and/or width from one another, or may be disposed in the base at different angles from one another. Although the figures illustrate conventional toothbrush-like bristles, it is also contemplated that other materials may be employed, such as a matrix material, e.g., sponge material, or elastomeric material, and, unless otherwise indicated, these other embodiments are encompassed herein by use of the term "bristles."

As shown in FIGS. 1-2, the bristles 4 may be attached in a plurality of rows (e.g., from 2 to 6 rows, preferably 4 rows as shown) along opposing parallel perimeter edges of the device, although other bristle configurations are possible and within the knowledge of one skilled in the art. The bristles are preferably made of a soft, pliable material. In some embodiments, the bristles may be formed of a material selected from plastic, polypropylene, silicone, nylon, and combinations thereof. In one embodiment, each of the bristles is conical or cylindrical in shape. The bristles preferably have a maximum length that is less than 1 cm, e.g., less than 0.75 cm, less than 0.5 cm or less than 0.25 cm. In terms of ranges, the bristles preferably have a maximum length from 0.25 to 1 cm, e.g., from 0.25 to 0.5 cm.

The optional second bristles may be attached in rows along the one or more perimeter edges of the distal side of the device. In one embodiment, the device comprises at least one row of second bristles, e.g., at least two rows, at least three rows, or at least four rows. For example, in one embodiment, second bristles are provided in parallel rows on the base, but on opposing perimeter edges. In one embodiment, the base has a lateral cross-sectional shape having four perimeter sides, wherein a first pair of parallel sides oppose one another and a second pair of parallel sides oppose one another, and wherein a first perimeter side area comprises the first pair of sides and a second perimeter area comprises the second pair of sides. In this embodiment, the central region may be disposed between the first pair of sides and the second pair of sides. In a preferable embodiment, the first bristles are disposed along the first perimeter area of the base, and the second bristles are disposed along the second perimeter area of the base. The second bristles may also be provided in perimeter rows along the entire perimeter of the base.

The optional second bristles may be cylindrical in shape with a flat tip or may have a conical shape or other shape, so long as the second bristles are otherwise distinguishable in some respect from the first bristles. The second bristles may be the same color as the first bristles or may be a different color. In one aspect, the second bristles are formed of the same material as the first bristles, but have a different shape, color or angle (relative to the base), or other distinguishing characteristic from the first bristles. In another aspect, the second bristles are formed of a different material than the first bristles, and may or may not have the same shape, color or angle as the first bristles. In some embodiments, the second bristles are comprised of the same material as the first bristles. In other embodiments, the first bristles are made from a different material than the second bristles. For example, the second bristles may be made of a thicker material than the first bristles, or vice versa, but also preferably formed of a material selected from plastic, polypropylene, silicone, nylon, and combinations thereof. Additionally or alternatively, the second bristle may vary in length, color or angle from the first bristles.

In addition to the second bristles, any combination of additional bristles may optionally be included, e.g., third bristles, fourth bristles, etc. Each of these additional types of bristles may differ in a physical characteristic from the first bristles and/or second bristles in any of the above-described ways that the first and second bristles may differ, e.g., length, arrangement, cross-sectional shape, or material.

It is to be understood that the specific illustration of the bristles is merely for describing one non-limiting embodiment of the present invention. The invention can, however, be practiced with various combinations of the same or different bristles configurations. It is thereby possible to select the combination of bristle configurations, bristle materials and bristle orientations to achieve specific intended results, such as enhanced cleaning, tooth polishing, breath freshening, tooth whitening and/or massaging of the gums.

In a first embodiment, shown in FIGS. 1-2, the oral care composition is dissolved, dispersed or otherwise carried in solvent, preferably water, and pre-applied to and deposited onto bristles 4. The bristles are then dried, optionally under heat and/or vacuum to remove the solvent. In another embodiment, the oral care composition is pre-applied as a paste on top of either or both the first bristles and/or the second bristles, optionally followed by drying and/or curing.

Figure 4:
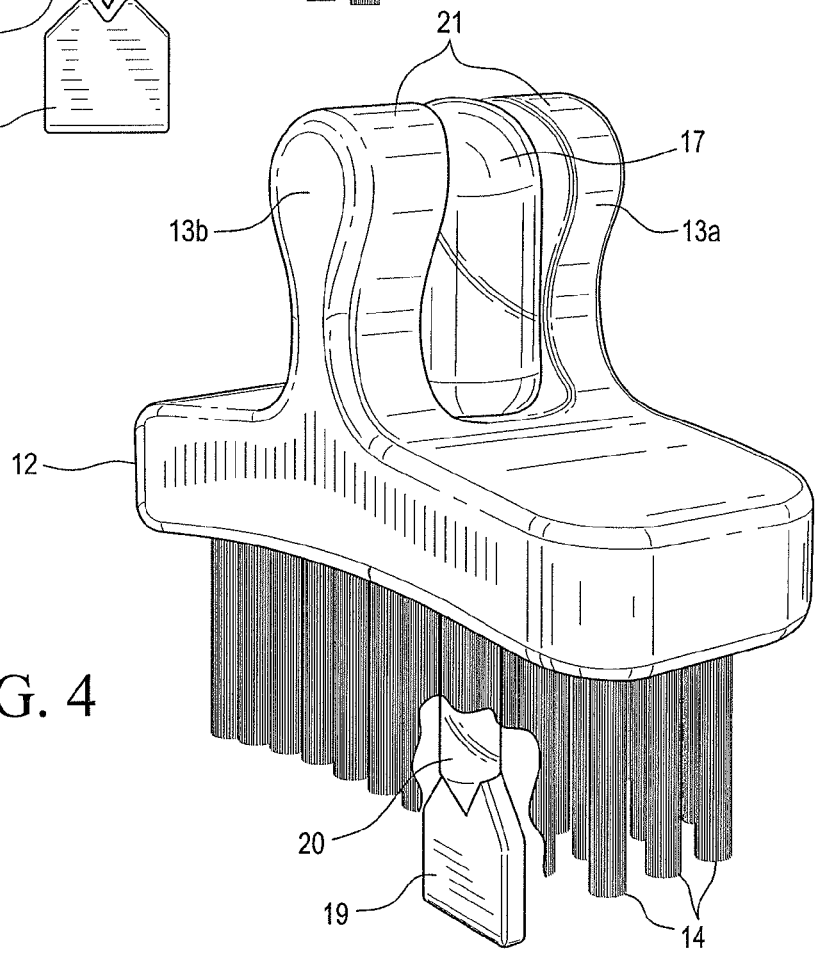
FIG. 4 is a perspective side view of the tooth cleaning device according to the second embodiment of the present invention.

In a second embodiment, shown in FIGS. 3-4, the oral care composition is not adhered onto the bristles but is contained within a separate housing, which preferably takes the form of a capsule 17. As shown, capsule 17 extends proximally from the first side of base 12, e.g., partially within grip member 13*a/b*. The capsule may be formed of a variety of materials but preferably is substantially flexible enough to be compressed by squeezing by a user's fingers. The capsule may be formed of a plastic, such as polyethylene and/or polypropylene, optionally in combination with one or more other plastics, silicone, nylon, or a combination thereof, and it may be clear, opaque, or translucent. In one embodiment, the capsule is formed of silicone. The capsule may be cylindrical, conical, prismatic or any other design, so long as the capsule includes a hollow space or cavity 18 therewithin in which to the oral care composition is stored. The cavity 18 is preferably large enough to contain an effective amount of oral care composition to clean or refreshen a user's teeth. Cavity 18 is optionally large enough to contain from 0.1 to 2 mL of oral care composition, e.g., from 0.25 to 1.5 mL or from 0.5 to 1 mL.

In one aspect, shown in FIGS. 3-4, the capsule comprises a tab 19, which extends distally through a slot in base 12. The tab may be formed of the same materials as the housing or of a different material. The tab may be clear, opaque, or translucent, or it may be colored. In a preferred embodiment, as shown, tab 19 extends distally through the center of base 12 among bristles 14. In other aspects, the tab may extend through any portion of the base 12, and may be oriented off-center. The tab preferably has dimensions such that it is longer than the maximum length of the bristles in order for the user to be able to easily grasp and remove the tab.

Tab 19 is preferably removable by the user, e.g., by twisting, bending, snapping, back and forth motion, breaking or other digital action. Removal of the tab creates an opening in the housing, through which the oral care composition may be dispensed by the user, preferably by squeezing the housing between the user's fingertips but optionally otherwise by application of pressure or force. The capsule preferably includes a conduit channel 20 and contains one or more perforations for facilitating tab removal. In the embodiment shown in FIGS. 3 and 4, the perforations are preferably in the region of arrow 21 such that after tab 19 has been removed, the remaining portion of capsule 17 does not extend into the region of bristles 14, and does not interfere with brushing and cleansing of the user's teeth. In preferred embodiments, the perforations are located on the capsule such that the tab may be easily removed to create an opening that is substantially flush or recessed within the base of the device. The perforations may take the form of slits, holes, or other aperture, or they may take the form of a different type of material, e.g., a more rigid material or thinner material. In some aspects, the oral care composition is temporarily held within the capsule by capillary forces even after tab removal, allowing the composition to be dispensed upon squeezing of the capsule. In another aspect, not shown, the capsule includes a valve in the region of the opening, which facilitates retention of the oral care composition within capsule until the capsule has been squeezed by the user.

In preferred embodiments, capsule 17 is held in place by a plurality of prongs 21. These prongs extend from the grip member to create a rim about the proximal boundary of the capsule, which secures the capsule in the device by frictional forces. The prongs may take the form of one singular prong that is circumferential about the proximal boundary of the capsule, or it may take the form of a plurality of smaller prongs that do not surround the proximal boundary of the capsule, e.g., two prongs (shown) 13*a*/13*b*, three prongs, or four prongs.

In preferred embodiments, capsule 17 is replaceable. In these embodiment, the capsule may be removed from its position in the grip member, preferably through the opening at proximal end of the grip member formed in the space between the plurality of prongs but optionally through any other opening in the device. A new capsule containing the oral care composition may then be inserted into the device. This would allow for the user to make repeated use of the same device.

Figure 5:
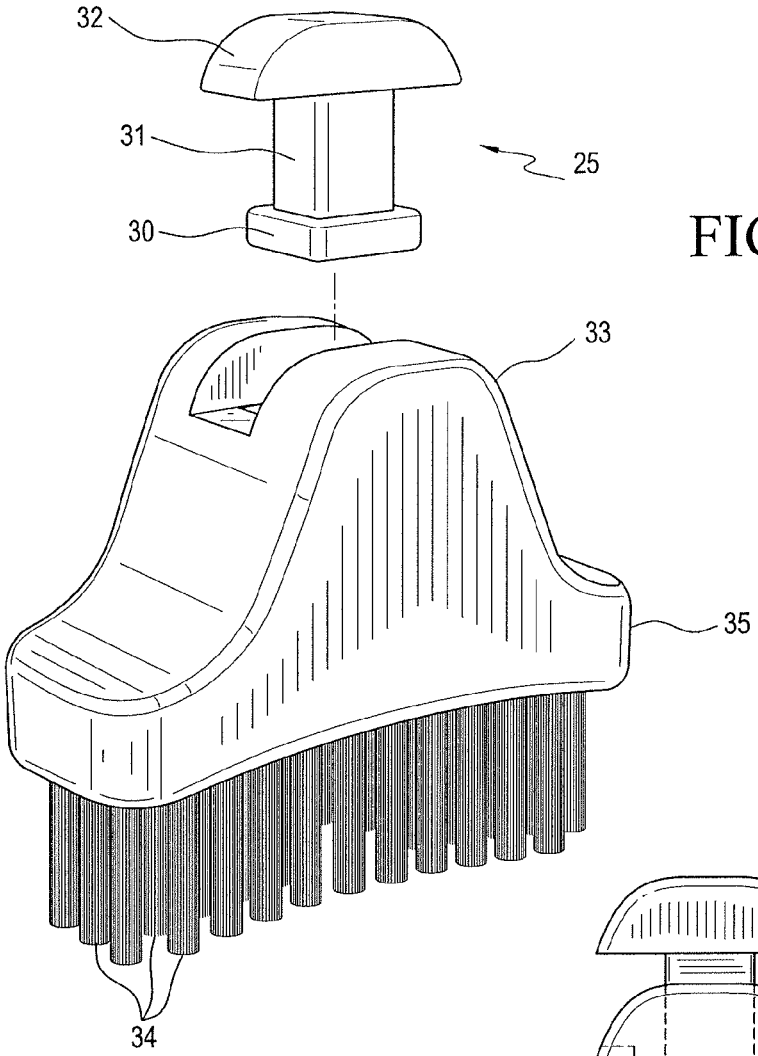
FIG. 5 is an exploded perspective view of a tooth-cleaning device according to a third embodiment of the present invention.
Figure 6:
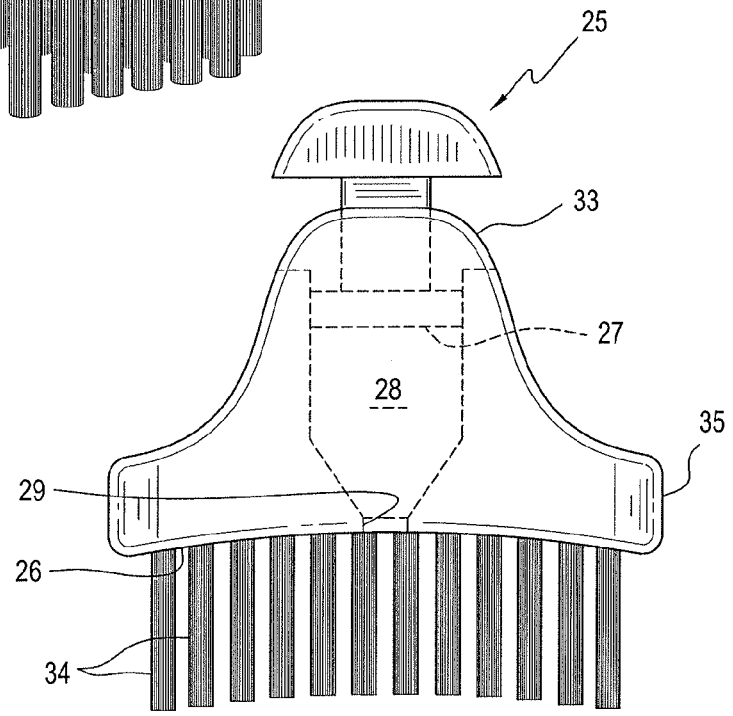
FIG. 6 is a side view of the tooth-cleaning device according to the third embodiment of the present invention.

In a third embodiment, as exemplified in FIGS. 5-6, the oral care composition is contained in a cavity 28 within the device itself rather than within a capsule (although it is contemplated that in some embodiments, a breakable capsule may be employed within the cavity). As shown, the cavity 28 is defined within the grip member 33 and base 35 by a distal surface 27 formed by a plunger 25, an opening 29 to the distal surface 26 of base 35, and one or more side wall(s) within the grip and base members. The dimensions of the cavity may vary widely but preferably are sufficient to hold from 0.1 to 2 mL of oral care composition, e.g., from 0.25 to 1.5 mL or from 0.5 to 1 mL.

In preferred embodiments, as shown in FIGS. 5-6, the cavity 28 is proximally bounded by a plunger 25, and specifically the distal surface 27 of plunger 25. The plunger may be formed of a plastic, such as polyethylene and/or polypropylene, optionally in combination with one or more other plastics, silicone, nylon, or a combination thereof. The plunger may be formed of the same materials as the grip member or of different materials. The plunger may be clear, opaque or translucent, or it may be colored. As shown, the plunger comprises a sealing portion 30, a shaft 31 and a proximal "pushing" portion 32, although other configurations are possible. Each of the sealing portion, the shaft and the proximal portion may be made of the same materials or different materials. Preferably sealing portion 30 forms a sealed boundary within hollow chamber 28, as shown in FIGS. 5-6, and is held in place within the grip member 33 through frictional forces.

In preferred embodiments, plunger 25 has two positions: a first position, wherein the plunger protrudes proximally from the grip member (see FIG. 6), and a second position (not shown), wherein the plunger is depressed longitudinally and protrudes proximally to a lesser extent than the first position. In some embodiments, the plunger does not protrude proximally of the base while in the second position, but is flush with the grip member. Depression of the plunger by a user forces the oral care composition stored within cavity 28 through opening 29 to the distal surface 26 of base 35 and onto bristles 34. Opening 29 may include a valve or may not include a valve, in which case the oral care composition may be retained within cavity 28 via capillary forces. In a preferred embodiment, shown in FIGS. 5-6, the user may move plunger 10 distally by pressing down (distally) on proximal portion 25 with the user's finger or thumb.

In some embodiments, the plunger locks into place when fully depressed into the second position. This may be accomplished by a plurality of prongs within the cavity that hold the bottom portion in place, a plurality of prongs within the grip member that hold the top portion in place, and/or by any other convenient means.

Packaging of Tooth Cleaning Devices

In another embodiment, the invention is directed to a packaging device for storing and transporting any of the above-described tooth cleaning devices. The packaging device comprises a substantially rigid sleeve 71 and an insert 79, slidably engaged therewith, optionally containing multiple tooth cleaning devices 1. The sleeve preferably is formed of a paperboard or plastic material having a rectangular cross-section and configured for mating with the insert, as shown in FIGS. 7-8.

Insert 79 preferably comprises a housing, preferably formed of a plastic material, having multiple cavities, each for housing a respective tooth cleaning device. Each tooth cleaning device is individually sealed within the insert. A sealing material, preferably formed of a metallic foil, is adhered to the housing, optionally by an adhesive or fusing, and covers the multiple cavities such that the tooth cleaning devices are securely stored therein. Upon application of pressure to the housing in the region of a cavity, for example by a user's finger, a tooth cleaning device breaks through the sealing material and into the user's hand for subsequent tooth cleaning.

The insert is slidably engaged with the sleeve between a first position and a second position. In the first position, the insert is substantially fully contained within the sleeve. Preferably, dispensing of the tooth cleaning devices is restricted or prevented when in the first position. In the second position, as shown in FIG. 7, insert 79 extends at least partly outside of the sleeve such that one or more of the tooth cleaning devices can be dispensed from the insert upon application of pressure by a user, as described above.

Figure 7:
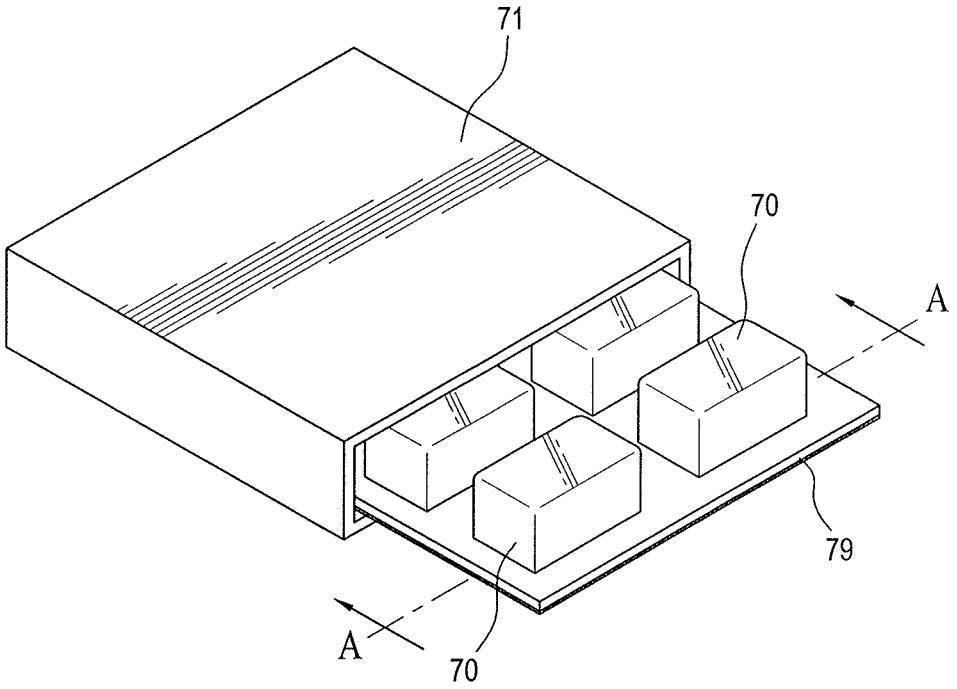
FIG. 7 is a perspective view of a packaging device in accordance with another embodiment of the invention.
Figure 8:
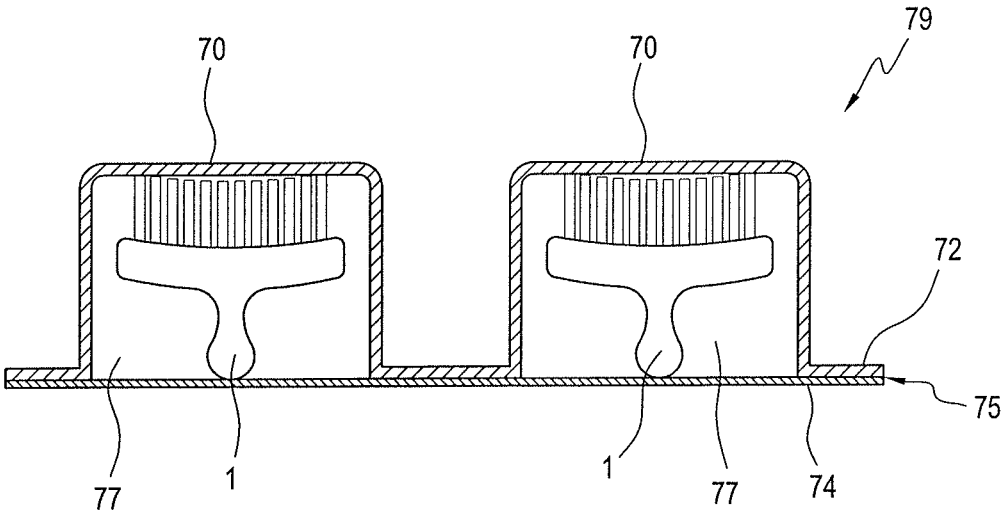
FIG. 8 is a side cross-sectional view of the device of FIG. 7, taken along line A-A.

FIGS. 7-8 illustrate an exemplary packaging device comprising a substantially rigid sleeve 71 and an insert 79 containing multiple tooth cleaning devices, e.g., at least 2, at least 4, at least 6 tooth cleaning devices. In one embodiment, a plurality of tooth cleaning devices, e.g., from 2 to 12, e.g., from 4 to 8 or about 6 devices, are individually sealed within insert 79. In preferred embodiments, sleeve 71 is made of paper board or plastic. Insert 79 is slidably engaged with the sleeve 71 between first and second positions, as described above. In the first position, insert 79 is contained within the sleeve for storage. As shown in FIG. 7, in the second position, insert 79 extends at least partly outside of the sleeve allowing for one or more of the tooth cleaning devices to be dispensed therefrom.

Insert 79 preferably is formed of a housing 72 comprising a plastic material, preferably in the form of a sheet that defines a plurality of cavities 77, each for housing a respective tooth cleaning device 1. The housing also comprises a sealing material 74, preferably a foil sheet, adhered to housing 72 and covering each of the cavities. An adhesive, not shown, may be used at the interface 75 between housing 72 and sealing material 74. The housing may be opaque, translucent, substantially clear or clear. The housing is shaped to include a plurality of cavities, allowing for placement of each of the individual tooth cleaning devices within a respective cavity for individual storage. The foil is optionally perforated around the perimeter of the each tooth cleaning device cavity to facilitate dispensing thereof. This allows for easy separation of individual tooth cleaning devices from the insert without disturbing the seal of the remaining devices in the package. The tooth cleaning devices can be released from the insert by application of pressure by a user to the outside of the plastic cavity that houses a tooth cleaning device, thereby forcing the tooth cleaning device through the sealing material on the opposite side of the insert.

Process for Using Tooth Cleaning Devices

In another embodiment, the invention is directed to a process for using any of the above-described tooth cleaning devices. In one aspect, for example, the process involves the use of a device of the type above described and shown in FIGS. 1-2, wherein the oral care composition is adhered to the bristles at the time of manufacture, and comprises the steps of: (a) gripping the grip member; and (b) activating the oral care composition with the user's saliva and brushing the user's teeth with the first and second bristles.

In a second aspect, for example, the process involves the use of a device of the type described above and shown in FIGS. 3-4, wherein the oral care composition is contained in a housing within the grip member, and comprises the steps of: (a) gripping the grip member; (b) removing a tab and squeezing the oral care composition out of the housing onto the bristles; and (c) activating the oral care composition with the user's saliva and brushing the user's teeth with the first and second bristles.

In a third aspect, for example, the process involves the use of a device of the type described above and shown in FIGS. 5-6, wherein the oral care composition is contained within a hollow chamber in the grip member 33 and/or base member 35, and comprises the steps of: (a) gripping the grip member; (b) distally moving a plunger to force the oral care composition out of the housing onto the bristles; and (c) activating the oral care composition with the user's saliva and brushing the user's teeth with the first and second bristles.

The disposable tooth cleaning devices of the present invention advantageously provide many benefits, including the cosmetic benefits of cleaning one's teeth while "on the go," without a toothbrush and/or toothpaste or without a source of water. The cosmetic benefits achieved by the present invention include the broad surface cleaning of one's teeth with the matrix material(s), e.g., sponge, and/or bristles, breath freshening with the oral care composition, and the cleaning of debris between teeth with bristles and/or one or more matrix materials.

Oral Care Composition

As discussed above, the tooth cleaning device preferably comprises an oral care composition. The oral care composition may be impregnated, coated, layered, or otherwise preloaded into or onto the device. An exemplary oral care composition is disclosed in U.S. Pat. No. 8,715,625, which is incorporated herein by reference in its entirety. Unless otherwise stated, amounts listed in percentage are in weight percent ("wt. %"), based on the total weight of the composition.

The oral care composition may comprise one or more of the following: carriers, cleaning agents, surfactants, thickening agents, buffering agents, whitening agents, sweeteners, and/or flavorants.

As in many commercially available oral care compositions, an inert carrier may be the primary ingredient in the oral care compositions. The amount of the carrier in the overall oral care composition may vary from 30% to 75%, e.g. from 35% to 70%, from 40% to 60%, from 50% to 75%. The common inert carrier is water. Other examples of carriers may include sorbitol, glycerol, vegetable glycerin, and combinations thereof.

The cleaning agent, optionally a cleaning solvent, may be used to remove stains from teeth and should be orally acceptable (non-toxic). The amount of the cleaning agent in the overall oral composition may vary from 0.1% to 5%, e.g., from 0.1% to 3%, 0.5% to 3%, from 1% to 4%. Preferably, the cleaning agent is water miscible and hydrophilic. Without being bound by theory, the cleaning agent preferably improves the wetting properties of the overall oral care composition to allow for better penetration of the tooth surface and thereby improved stain removal. Examples of cleaning agents include water, deionized water, purified water, ethanol, glycerol, propylene glycol, PEG-60, PEG-400, PEG-600, benzyl alcohol, methyl salicylate, phenol, acrylic acid, orange oil, acetic acid, vinegar, acetone, formic acid, methanol, propanol, ethanolamine, lactic acid ethyl ester, propionic acid, diethanolamine, triethanolamine, diethylene glycol, diethylamine, triethylamine, tetraethylene glycol, formaldehyde, 1-octanol, and mixtures thereof. In some embodiments, the cleaning agent comprises water and/or ethanol.

The amount of optional surfactant in the overall oral composition may vary from 0.1% to 5%, e.g., from 0.1% to 3%, 0.5% to 3%, from 1% to 4%. The surfactant may comprise non-ionic surfactants, cationic surfactants and/or anionic surfactants. Examples of surfactants include sodium lauryl sulfate (SLS), sodium-N-lauroyl sarcosinate, Pluronic F68, Pluronic F88, poloxamer 188, poloxamer 124, poloxamer 338, poloxamer 407, dioctyl sodium sulfosuccinate, ethylene oxide polymer, polyethyloxylated castor oil, cremophor 40, hydrogenated castor oil, and mixtures thereof.

Non-ionic surfactants may be selected from the group consisting of phosphates, sulfates, polysorbates, sorbitan esters, polyoxyethylene sorbitan esters, low viscosity hydroxyethyl cellulose, polysorbates, fatty alcohol ethoxylates, monoglycerides, soybean lecithin, polyethylene oxide condensates of alkyl phenols, products derived from the condensation of ethylene oxide with the reaction product of propylene oxide and ethylene diamine, ethylene oxide condensates of aliphatic alcohols, long chain tertiary amine oxides, long chain tertiary phosphine oxides, long chain dialkyl sulfoxides, and mixtures thereof. Anionic and amphoteric surfactants may include, but are not limited to, derivatives of aliphatic secondary and tertiary amines in which the aliphatic component may be a straight chain or branched. The aliphatic substituents may contain from about 8 to about 18 carbon atoms and one may contain an anionic water-solubilizing group, e.g., carboxylate, sulfonate, sulfate, phosphate, phosphonate, betaines (e.g., cocamidopropyl betaine), or a mixture thereof. Many of these nonionic and amphoteric surfactants are disclosed in U.S. Pat. No. 4,051,234, which is incorporated herein by reference in its entirety.

Cationic surfactants that may be useful in the oral care composition may be broadly defined as derivatives of aliphatic quaternary ammonium compounds having one long (e.g., $C_{8-18}$) alkyl chain. The cationic surfactant may also act as a germicide. Examples of cationic surfactants include lauryl trimethylammonium chloride, cetyl pyridinium chloride, cetyl trimethylammonium bromide, di-isobutylphoxyethyl-dimethylbenzylammonium chloride, coconut alkyltrimethylammonium nitrite, and those described in U.S. Pat. No. 3,535,421, the entirety of which is incorporated herein by reference.

Additional surfactants may include sodium carbonate (anhydrous), sodium bicarbonate (baking soda), potassium iodide, and mixtures thereof. In one embodiment, the surfactant is a combination of a block co-polymer of polyoxyethylene and polyoxypropylene, e.g., poloxamer 407, and hydrogenated castor oil.

A buffering agent may be used to adjust the pH of the oral care composition. The amount of the buffering agent in the overall oral composition may vary from 0.1% to 5%, e.g., from 0.1% to 3%, 0.5% to 3%, from 1% to 4%. Preferably, the amount of buffering agent will be sufficient to adjust the pH of the oral care composition to an acceptable range, e.g., from 4 to 9, from 5 to 8, from 6 to 8. Examples of buffering agents include potassium hydroxide (KOH), ammonium hydroxide, sodium citrate, sodium bicarbonate (baking soda), sodium hydroxide, calcium hydroxide, calcium phosphate tribasic, dipotassium phosphate, sodium monobasic phosphate and sodium dibasic phosphate (optionally anhydrous), sodium aluminum phosphate, sodium tripolyphosphate, sodium benzoate, acetic acid, sodium acetate, citric acid, sodium citrate, benzoic acid, sodium hexametaphosphate, and mixtures thereof.

Thickening agents may be used to adjust the viscosity of the oral care composition. The amount of thickening agents in the overall oral composition may vary from 0.1% to 5%, e.g., from 0.1% to 3%, 0.5% to 3%, from 1% to 4%. Examples of thickeners include hydrocolloids, e.g., guar gum, locust bean gum, gum acacia, alginic acid, carrageenan, gelatin, methylcellulose, sodium carboxymethylcellulose, polyacrylates, polyethylene oxides, carnauba wax, beeswax, paraffin, mineral oil, and mixtures thereof.

The amount of whitening agents in the overall oral composition may vary from 0.1% to 25%, e.g., from 0.1% to 15%, from 0.1% to 10%, from 1% to 10%. Examples of whitening agents include peroxygens, peroxides, metal chlorites, perborates, percarbonates, peroxyacids, persulfates and mixtures thereof. For example, the whitening agent may comprise one or more of hydrogen peroxide, carbamide peroxide, calcium peroxide, glyceryl peroxide, benzoyl peroxide, calcium chlorite, barium chlorite, magnesium chlorite, lithium chlorite, sodium chlorite, potassium chlorite, sodium hypochlorite, chlorine dioxide, and the like.

The addition of sweeteners is important to make the oral care composition palatable. The amount of sweetener in the overall oral composition may vary from 0.1% to 25%, e.g., from 0.1% to 15%, from 0.1% to 10%, from 1% to 10%. Preferably, the amount of sweetener in the overall oral care composition is sufficient to render the composition palatable to the user. The sweetener is preferably water soluble and may be natural or artificial. Examples of sweeteners include xylose, ribose, glycose, mannose, galactose, glucose, fructose, dextrose, sucrose, maltose, sorbitol, xylitol, mannitol, sodium saccharin, calcium saccharin, sucralose, 3,6-dihydro-6-methyl-1,2,3-oxanthiazin-4-one-2,2-dioxide, potassium (Acesulfame-K), and mixtures thereof.

The flavor of an oral care composition is an important consideration of consumers. As such, the oral care composition may comprise a flavorant, which may be used to enhance the flavor and palatability of the composition. The amount of flavorant in the overall oral composition may vary from 0.1% to 25%, e.g., from 0.1% to 15%, from 0.1% to 10%, from 1% to 10%. Preferably, the amount of flavorant in the overall oral care composition is sufficient to render the composition palatable to the user. Examples of flavorants include natural peppermint flavor, anise oil, clove oil, peppermint oil, spearmint oil, menthol, methyl salicylate, blackberry, strawberry, chocolate, vanilla, cherry, grape, lime, lemon, mint, and the like.

The oral care composition may also include one or more additional additives, such as: (i) abrasives e.g., mica, calcium phosphates, sodium bicarbonate (baking soda), alumina, calcium carbonate (chalk), silica; (ii) preservatives, e.g., potassium sorbate; (iii) chelating agents, e.g., etidronic acid; (iv) tartar control ingredients, e.g., disodium pyrophosphate; (v) colorants, e.g., titanium dioxide, mica; (vi) antioxidants, e.g., fluorides including potassium stannate; (vii) vitamins; (viii) plant extracts. Additionally, any other ingredients generally known to those skilled in the art may be included in the oral care composition.

In one embodiment, the oral care composition may comprise water, baking soda, titanium dioxide, sorbitol, potassium sorbate, cetyl pyridinium chloride, xylitol, guar gum, sodium benzoate, methanol, ammonium hydroxide, etidronic acid, disodium pyrophosphate, potassium stannate, hydrogenated castor oil, PEG-60, carnauba wax, mica, natural peppermint flavor, sucralose, sodium saccharin, carbomer, ethanol and poloxamer 407.

In addition to the cosmetic benefits, the above-described disposable tooth cleaning devices also provide economic benefits in that they are both quickly and economically manufactured. The present invention also provides a convenience benefit as it allows for maintenance of oral health without the need for toothpaste, water, mouth wash, a toothbrush, or containers to hold same.

Other embodiments of the invention will be apparent to those skilled in the art from consideration of the specifications and practice of the invention disclosed herein. It is intended that the specification and examples be considered as exemplary only, with a true scope and spirit of the invention being indicated by the following claims.

I claim:

1. A tooth cleaning device, comprising:

a substantially planar base having opposing first and second sides;

a grip member extending proximally from the first side, wherein the grip member comprises a convex upper portion and two opposing concave lower portions extending from opposing sides of the first side, and further wherein the grip member comprises two planar side portions extending from the substantially planar base to the convex upper portion;

a plurality of first bristles attached to and distally extending from the second side;

optionally a plurality of second bristles attached to and distally extending from the second side; and an oral care composition disposed within a housing or on the first bristles.

2. The device of claim 1, wherein the oral care composition is disposed on the first bristles as a solid at room temperature, and wherein said solid is activated upon contact with a user's saliva.

3. The device of claim 1, wherein the housing comprises a flexible capsule disposed at least in part within the grip member and extending through the base, said capsule further comprising a removable tab extending distally from the second side of the base.

4. The device of claim 3, wherein the capsule comprises one or more perforations for facilitating removal of the tab, wherein removal of the tab creates an opening through which the oral care composition may be dispensed.

5. The device of claim 3, wherein the capsule is held in place by a plurality of prongs extending from the grip member to create a rim about a proximal boundary of the capsule.

6. The device of claim 3, wherein the capsule is replaceable.

7. The device of claim 3, wherein the capsule is formed of a material selected from the group consisting of plastic, polypropylene, silicon, nylon, and combinations thereof.

8. The device of claim 1, wherein the housing is in the form of a cavity within the grip member, bounded proximally by a plunger and distally by an opening to the second side of the base, wherein the device has a first position wherein the plunger protrudes proximally from the grip member, and a second position where the plunger is depressed laterally into the grip member and protrudes proximally to a lesser extent than the first position.

9. The device of claim 8, wherein distal movement of the plunger disperses the oral care composition through the opening and onto the first bristles, and optionally such that when fully depressed, the plunger is locked into place by a plurality of prongs.

10. The device of claim 1, wherein the base has a lateral cross-sectional shape that is selected from the group consisting of circle, oval, square, rectangle, and triangle.

11. The device of claim 1, wherein the grip member has a proximal grip length, and the base has a maximum lateral dimension, and wherein the ratio of the proximal grip length to the maximum lateral dimension is less than 2.

12. The device of claim 1, further comprising the plurality of second bristles attached to and distally extending from the second side, wherein the first bristles are disposed along a first perimeter area of the base, and the second bristles are disposed along a second perimeter area of the base.

13. The device of claim 1, wherein the first bristles have a maximum length less than 1 cm.

14. The device of claim 1, wherein the first bristles extend distally from the second side of the base at an angle ranging from 35 to 55 degrees.

15. The device of claim 1, wherein the oral care composition is selected from the group consisting of: cleaning agents, surfactants, thickening agents, buffering agents, whitening agents, sweeteners, flavorants, and combinations thereof.

* * * * *